United States Patent [19]

Minner

[11] 4,392,474

[45] Jul. 12, 1983

[54] ELECTRONIC IGNITION SYSTEM

[75] Inventor: Willy Minner, Schwaigern, Fed. Rep. of Germany

[73] Assignee: Licentia Patent-Verwaltungs-GmbH, Frankfurt am Main, Fed. Rep. of Germany

[21] Appl. No.: 254,395

[22] Filed: Apr. 15, 1981

[30] Foreign Application Priority Data

Apr. 25, 1980 [DE] Fed. Rep. of Germany ..... 3015939

[51] Int. Cl.[3] ..... F02P 3/00; F02P 3/04; F02P 5/04

[52] U.S. Cl. ..... 123/644; 123/610; 123/630

[58] Field of Search ..... 123/644, 630, 610, 146.5 A

[56] References Cited

U.S. PATENT DOCUMENTS

| | | | |
|---|---|---|---|
| 3,882,840 | 5/1975 | Adamian et al. | 123/644 |
| 4,008,698 | 2/1977 | Gartner | 123/644 |
| 4,030,468 | 6/1977 | Sugiura et al. | 123/644 |
| 4,114,582 | 9/1978 | Rabus et al. | 123/644 |
| 4,153,032 | 5/1979 | Château | 123/610 |
| 4,174,696 | 11/1979 | Jundt et al. | 123/644 |
| 4,196,711 | 4/1980 | Daumar | 123/644 |
| 4,204,508 | 5/1980 | Jundt et al. | 123/644 |
| 4,245,610 | 1/1981 | Sugiura | 123/644 |
| 4,248,200 | 2/1981 | Sugiura et al. | 123/644 |
| 4,271,812 | 6/1981 | Bodig et al. | 123/644 |

FOREIGN PATENT DOCUMENTS 2011211 7/1979 United Kingdom .

*Primary Examiner*—Raymond A. Nelli
*Attorney, Agent, or Firm*—Spencer & Kaye

[57] ABSTRACT

An electronic ignition system comprising an ignition coil, having the spark gap in circuit with its secondary winding, a primary transistor and a current limiting circuit in circuit with its secondary winding, a filter transistor connected in front of said primary transistor and controlled by a control signal and a resistor network connected in the current path of the filter transistor, the filter transistor and the resistor network being so dimensioned that, during a rise in current in the primary winding, the further transistor is in saturated operation and a jump in the voltage across the resistor network to a constant maximum voltage when the current is limited by the current limiting circuit, a pulse being derivable from the voltage curve at the resistor network.

7 Claims, 6 Drawing Figures

ELECTRONIC IGNITION SYSTEM

BACKGROUND OF THE INVENTION

The invention relates to an electronic ignition with an ignition coil, in which the primary winding lies in a circuit with a transistor controlled by a control signal and a current limiting circuit whereas the secondary winding lies in the circuit of the spark gap.

Conventional automobile ignition devices operate with a mechanical contact, which is opened and closed. This contact lies in the circuit of the primary winding of the ignition coil, which is connected between the poles of the battery. If the contact is closed a current $I_{pr}$, flows through the primary winding which corresponds to a magnetic energy, related to the primary winding $L_1$ of a magnitude $$E_M = L_1/2 \cdot I_{pr}^2$$

When opening the switch, this energy is released and produces a voltage, with which the spark plug is ignited on the secondary side and thus the magnetic energy may be converted into spark energy.

The switch is opened and closed by the crankshaft of the engine; in a conventional 4-stroke engine the contact has to be opened and closed twice during one rotation of the crankshaft. If the engine runs for example at a speed of 5,000 revolutions per minute then this corresponds to a cycle duration of the ignition contact of 6 ms. At a speed of 2,500 revolutions per minute the cycle duration increases to 12 ms. The ignition coil used has a time constant because of its resistance loss and requires a time of 5 ms for example for the rise in the primary current from 0 to 7.5 A, when there is a battery voltage of 10 V. A further period of 1 ms is provided for breaking down the energy of the ignition spark at a speed of 5,000 rpm. The contact is therefore closed for 5 ms at the said speed, the current through the primary coil rising to the desired value of 7.5 A during this time. The ratio between the contact closing time and the cycle duration is designated as the closure angle. This closure angle s is therefore $s=5/6=83.3\%$ in the example stated. This closure angle is between 65 and 85% depending on the number of cylinders of the engine.

If the closure angle given by way of example as $s=83.3\%$ is maintained, then with a speed of 2,500 revolutions there is a contact closure time of 10 ms and a contact opening time of 2 ms. These cycle times are doubled when the engine speed is halved again. It is apparent from this that the current through the primary winding of the ignition coil at speeds of less than 5,000 revolutions per minute rises beyond the maximum value of 7.5 A for example which is required for ignition. This is not desirable since the energy in the ignition coil rises with the current and therefore more heat has to be converted. This may lead to the destruction of the ignition system at very low speeds and at fairly high battery voltages.

A current limiting circuit has been proposed for limiting the current to the required maximum value.

Since, in this known system, the energy stored in the coil is only dependent on the level of the current and not on the cycle of the current flow, there is an output loss resulting from the residence time of the primary current at its maximum, which cannot be used to ignite the spark gap. Therefore it is desired to shift the beginning of the increase in current in the primary winding of the ignition coil so that the current reaches its maximum value at the moment of the ignition pulse. However, in order to control this process, it is necessary to derive a variable value from the residence time of the maximum current in the primary winding of the ignition coil, which value may then be used to control the electronic ignition system.

SUMMARY OF THE INVENTION

It is an object of the invention to provide distinct criterion which can be used to establish when the current through the primary winding of the ignition coil reaches its constant maximum.

According to a first aspect of the invention, there is provided an electronic ignition system comprising an ignition coil having a primary winding and a secondary winding circuit with the spark gap, a primary transistor and a current limiting circuit in the circuit of said primary winding, a further transistor, controlled by a control signal and connected in front of said primary transistor, and a resistor network in the current path of said further transistor and means for deriving pulses representing the residence time of maximum current through said primary winding from the voltage curve at said resistor network with said further transistor and said resistor network dimensioned to cause said further transistor to operate in the saturation region when there is a rise in current in said primary winding providing a jump in voltage to a constant maximum value at said resistor network when said current in said primary winding is limited by said current limiting circuit.

According to a second aspect of the invention, there is provided an electronic ignition system with an ignition coil, the primary winding of which is in a circuit having a primary transistor controlled by a control signal and with a current limiting circuit, while the secondary winding is in the circuit of the spark gap, wherein a further transistor which is controlled by the control signal is connected in front of said primary transistor in the circuit of the primary winding, a resistor network is arranged in the current path which supplies control current of the primary transistor and said further transistor and said resistor network are so dimensioned that, during a rise in current in the primary winding said further transistor operates in the saturation region and there is a jump in the voltage to a constant maximum value when the current in the primary winding is limited by the current limiting circuit at the resistor network so that a pulse can be derived from the voltage curve at said resistor network and from the control signal the width of said pulse being a measure of the residence time of the current through the primary winding at its maximum.

BRIEF DESCRIPTION OF THE DRAWINGS

The invention will now be described in greater detail by way of example, with reference to the drawings, in which.

DESCRIPTION OF THE PREFERRED EMBODIMENT

Figure 1:
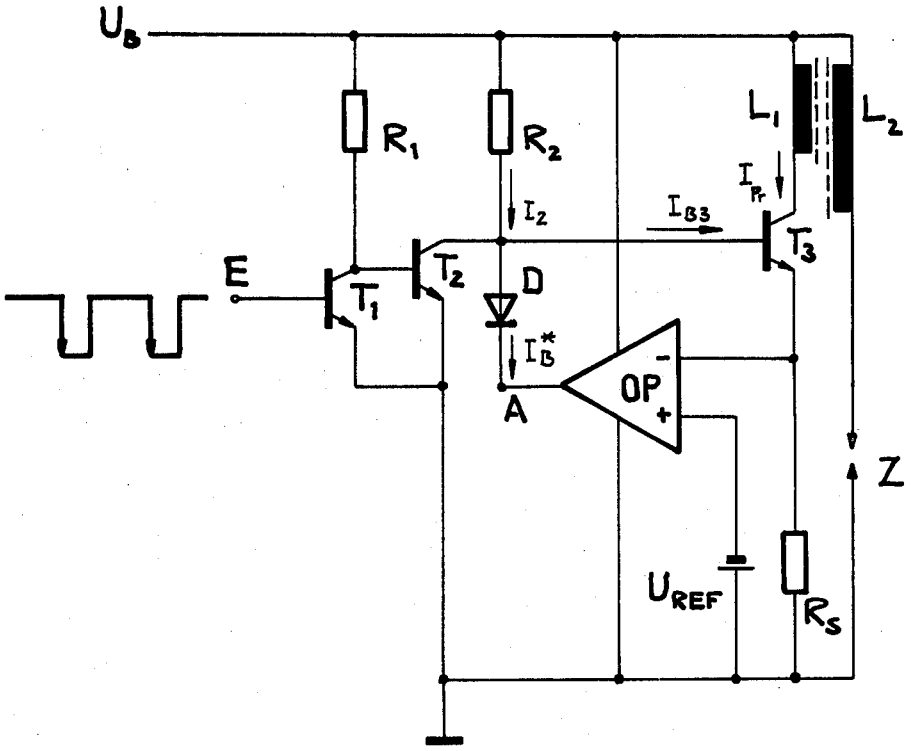
FIG. 1 is a circuit diagram of a known electronic ignition system.

Referring firstly to FIG. 1, a current limiting circuit which has been proposed for limiting the current in an electronic ignition system will be explained briefly.

Figure 3:
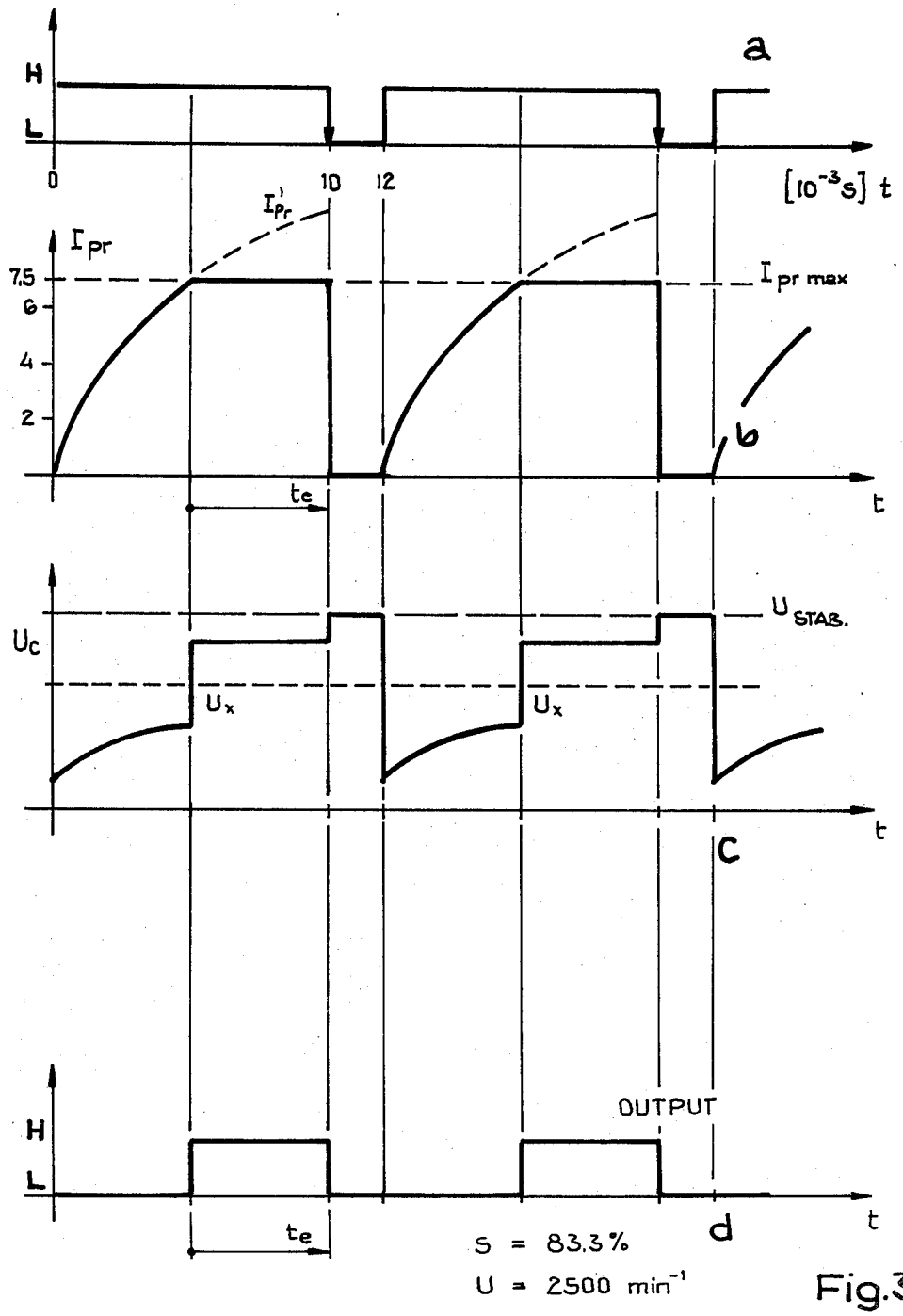
FIGS. 3*a* to 3*d* are graphical representations of various signals for explaining the operation of the circuits of FIGS. 1 and 2.

A transistor $T_3$ and an emitter resistor $R_s$ are connected into the circuit bands of a primary winding $L_1$ of an ignition coil. The transistor $T_3$ is controlled via transistors $T_1$ and $T_2$ by a control signal. The control signal is shown in FIG. 3*a* and is obtained at the engine shaft, for example with a magnetic element with a Hall sensor. The high level at the base of the transistor $T_1$ causes this transistor to become conductive and therefore the transistor $T_2$ connected thereafter is blocked. Thus, the current $I_2$ drawn via a resistor $R_2$ can flow as the base current $I_{B3}$ into the base of the transistor $T_3$ and modulate it so that the current through the inductance $L_1$ can rise slowly. The rise in current is shown in FIG. 3*b*. This current $I_{pr}$ through the primary winding is sensed across the resistor $R_s$, and the voltage dropping across this resistor is compared with a reference voltage $U_{REF}$ by means of an operational amplifier OP. If the voltage at $R_s$ exceeds the value of the reference voltage, for example at a coil current of 7.5A which is the case when the resistor $R_s$ and the reference voltage are dimensioned appropriately, the output A of the operational amplifier OP becomes negative and draws just enough current $I_B$* from the base of the transistor $T_3$, via a diode D, that the value of $I_{pr}$ does not continue to rise. The current path shown in FIG. 3*b* results. The current path $I_{pr}'$, shown in broken lines, would be present if a current limiting circuit of the type described were not present.

When the input signal at the base of the transistor $T_1$ goes over to Low, the transistor $T_1$ is blocked and consequently the transistor $T_2$ is conductive. The current $I_2$ may therefore flow through the transistor $T_2$ and the transistor $T_3$ is blocked. Ignition is therefore triggered and this is indicated by the arrow which points downwards in FIG. 3*a*. The residence time $t_e$ of the primary current $I_{pr}$ is largely dependent on the speed at its maximum since the same time of 5 ms for example is always required for the rise in current up to 7.5 A.

Since the energy stored in a coil is only dependent on the level of the current and not on the cycle of the current flow, there is an output loss to be conducted away by the transistor $T_3$ which results from the residence time of the primary current at its maximum, which cannot be used to ignite the spark gap Z. Therefore it is desired to shift the beginning of the increase in current in the primary winding of the ignition coil so that the current reaches its maximum value at the moment of the ignition pulse. However in order to control this process, it is necessary to derive a variable value from the residence time $t_e$ of the maximum current $I_{pr}$, which value may then be used to control the electronic ignition system in the manner described. This variable value cannot be derived from the characteristics of the operational amplifier OP according to FIG. 1, since the transmission characteristic of this operational amplifier is not supposed to exhibit a jump, but has to be flattened off. If the transmission characteristic of the operational amplifier were to have a jump, in some circumstances this would lead to misignition, which should be avoided at all costs.

In a preferred form of the invention, it is proposed that, in an electronic ignition system of the type described above, a further transistor, controlled by the control signal, is connected in front of the transistor in the circuit of the primary winding, a resistance network being arranged in the current path thereof, this current path supplying the control current of the subsequently connected transistor. By so dimensioning the further transistor and the resistance network that during the current rise in the primary winding, the further transistor operates in the saturation range and when the current is limited in the primary winding to a constant maximum value with the aid of the current limiting circuit, a voltage jump occurs across the resistance network so that a pulse may be derived from the voltage curve at the resistance network, and from the control signal, the pulse width being an indication of the residence time of the current through the primary winding when at its maximum.

The resistance network is preferably a resistance arranged in the collector current path of the further transistor which is connected to a supply potential. This supply potential is obtained, for example, as a stabilised potential through a suitable stabilising circuit. The emitter of the further transistor is connected to the base of the transistor in the circuit of the primary winding, while the base of the pre-connected transistor is connected via a diode path and a bias resistor to the stabilised potential and also to a switch and to the current limiting circuit. The arrangement is such that, when the spark gap is ignited, predetermined by the control signal, the base current of the further transistor is derived via the switch which is closed. This base current flows on its own into the base of the further transistor during which the current rise phase of the primary winding whereas as long as the primary winding current remains at its maximum the base current is derived by the current limiting circuit at its constant maximum on a scale which causes the current to be held constant. This current limiting circuit is preferably the operational amplifier OP which has already been described with reference to FIG. 1, a reference voltage being passed to one of its inputs and a voltage corresponding to the current in the primary winding being passed to its other input. The output of the operational amplifier is then connected to the base of the further transistor. The operational amplifier is a switching circuit, for example, which can be obtained commercially under the designation TAA 521.

Figure 2:
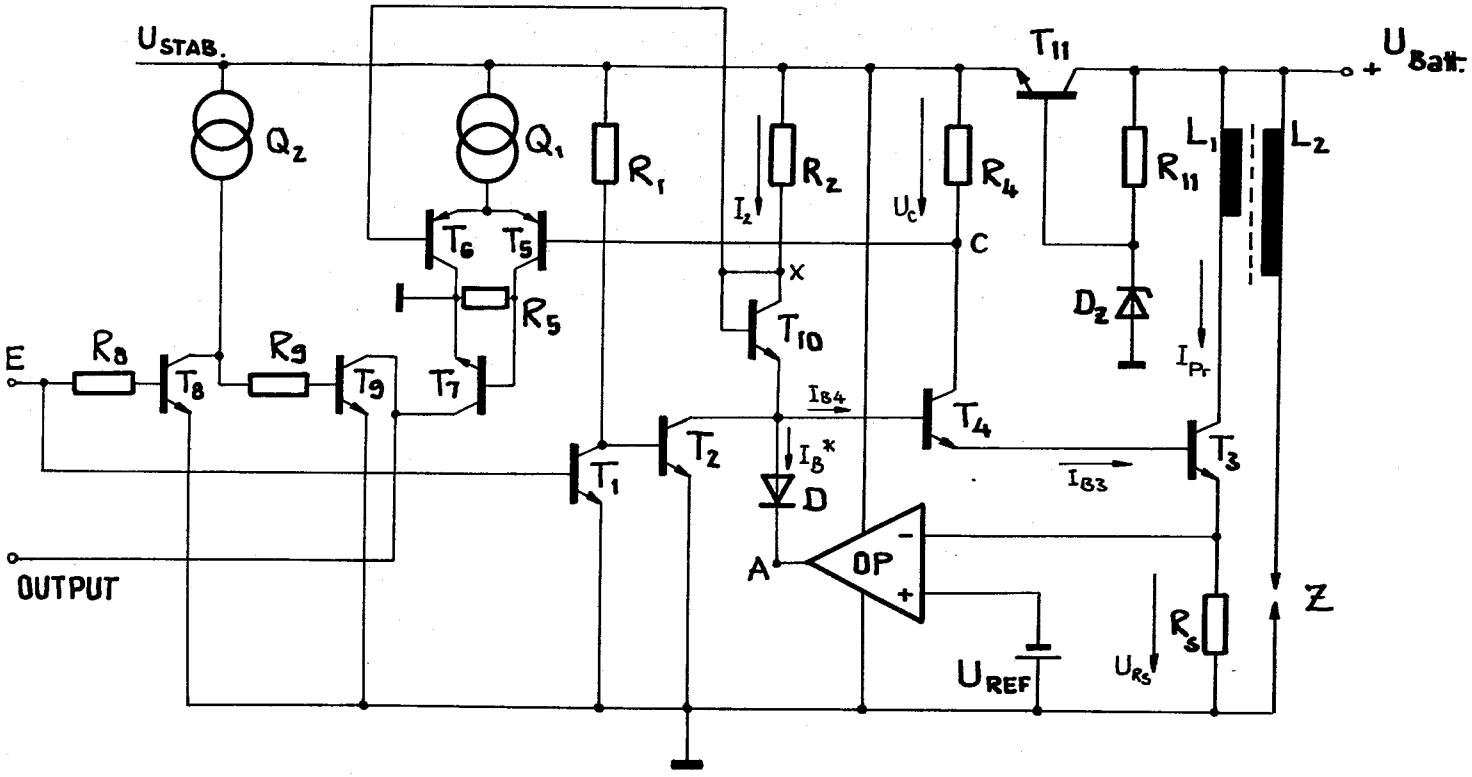
FIG. 2 is a circuit diagram of one form of electronic ignition system in accordance with the invention.

A circuit according to the invention is shown in FIG. 2. This circuit is an extended version of the circuit according to FIG. 1, but is based on the invention. In particular a further transistor $T_4$ has been added as compared to the circuit of FIG. 1, this transistor being connected in front of the transistor $T_3$ which lies in the circuit of the primary winding of the ignition coil. A collector resistor $R_4$ of this transistor $T_4$ lies at a stabilised potential $U_{stab}$, which is obtained from the battery voltage. A transistor $T_{11}$ is used for this and its base voltage divider comprises the series circuit of a resistor $R_{11}$ and a Zener diode $D_Z$. The stabilised voltage $U_{stab}$ is then the voltage reduced by $1\times 0_{BE}$ at the Zener diode $D_Z$.

The base electrode of the transistor $T_4$ is controlled via the collector of the transistor $T_2$, to which the output of the operational amplifier is connected via diode D, as is the series circuit comprising a transistor $T_{10}$ and the bias resistor $R_2$ which is connected to the stabilised potential $U_{stab}$. The transistor $T_{10}$ is connected as a diode operated in the flow direction. The transistors $T_3$ and $T_4$ are of the same type of conductivity, more particularly NPN bipolar transistors.

If the low potential of the control signal according to FIG. 3*a* is at the base of $T_1$, which is the case during the ignition phase, then $T_1$ is blocked whereas the transistor $T_2$ conducts. Then the current $I_2$ flowing through the bias resistor $R_2$ and the transistor $T_{10}$ is drawn off via the collector-emitter path of the transistor $T_2$ so that no current is able to flow through $T_3$ and $T_4$. The collector potential of $T_4$ at the point C corresponds therefore to the stabilised potential which arised from the diagram of FIG. 3*c*. If the control signal of FIG. 3*a* at the input E passes from Low to High, then the transistor $T_1$ becomes conductive and the transistor $T_2$ is blocked because of its low base potential. The current $I_2$ through the bias resistor $R_2$ is therefore available as the base current for the transistor $T_4$ so that current is able to flow through this transistor and therefore also through the transistor $T_3$. Because of the time constant of the ignition coil, only a very low current is able to flow through the primary winding $L_1$ and the collector of the transistor $T_3$, so that $T_4$ delivers the whole of the current, limited only by the resistor $R_4$. Thus the transistor $T_4$ operates in the saturation range so that a potential of approx. 0.7 to 1.4 V is applied to its collector C during the current rise phase through the primary winding $L_1$. This potential curve at the point C is in turn apparent from FIG. 3*c*. The potential at the point C rises as a result of the increasing voltage drop across the resistor $R_S$ during the current rise phase in the manner shown.

The collector current $I_{pr}$ through the transistor $T_3$ rises up to the point in time where the operational amplifier responds due to the equilibrium of voltages at its inputs and then draws a current $I_B$* of such a size through the output A that the current $I_{pr}$ remains constant.

If the resistor $R_4$ in the collector of the transistor $T_4$ is so dimensioned that the current limited by the said transistor by means of $R_4$ is substantially larger than the required base current of the transistor $T_3$ in the case of maximum current through the primary winding $L_1$ the voltage jumps to the value $$Uc = U_{stab} - I_{B3(Iprmax)} \cdot R_4$$

across resistor $R_4$ when the maximum current through the primary winding is reached.

This voltage value is essentially different from the value during the current rise phase through $L_1$. The potential at the point C, according to the diagram of FIG. 3*c* also jumps to a substantially higher value than during the current rise phase when the value $I_{prmax}$ is reached. The whole of the potential curve at the collector of the transistor $T_4$ is apparent from the diagram of FIG. 3*c*.

This potential curve is compared with the threshold potential at the point X which is the connecting point between the bias resistor $R_2$ and the diode path of the transistor $T_{10}$. The potential at the point X is above the base potential of the transistor $T_4$ at 1 $U_{BE}$ so that, during the current rise phase through the primary winding $L_1$, the potential at the point X is above the potential at the point C in any case. As a result of the potential jump at the point C, the threshold potential at the point X is below the collector potential of the transistor $T_4$ after $I_{prmax}$ has been reached. In the diagram of FIG. 3*c* the threshold potential at the point X when the contacts are closed is shown in broken lines.

The potentials at the point X and C are compared with each other with the aid of a comparator comprising the transistors $T_6$ and $T_5$. The transistors $T_5$ and $T_6$ are PNP transistors, the emitter electrodes of which are connected to the stabilized potentials via the current source $Q_1$. The collector of $T_6$ is at earth while the collector $T_5$ is connected to earth via the resistor $R_5$. The base-emitter path of an NPN transistor $T_7$, is in parallel with the resistor $R_5$ and its collector is connected to the output and to the collector of a transistor $T_9$. The base of the transistor $T_9$ is connected to the collector of a transistor $T_8$ via a bias resistor $T_9$, the current source $Q_2$ lying in its collector branch. The emitters of the NPN transistors $T_8$ and $T_9$ are at earth, while the control signal is passed to the base of the transistor $T_8$ via the base bias resistor $R_8$.

If the control signal is applied to the input E with Low potential, the transistor $T_8$ is blocked and the transistor $T_9$ is conductive. The collector of the transistor $T_9$ and therefore the output of the circuit is at earth potential. This is apparent from the diagram of FIG. 3*d* in which the output signal is shown graphically.

The base potential of the transistor $T_6$ is higher than that of the transistor $T_5$ in the contact closure time during the current rise phase of $I_{pr}$. Therefore the current flows from the current source $Q_1$ via the driven PNP transistor $T_5$ and the resistor $R_5$ to earth. There is then a voltage drop across resistor $R_5$, which is sufficient to drive the transistor $T_7$ so that the collector potential of the transistor $T_9$ and therefore the output is also drawn from $I_{pr}$ to earth during the current rise time.

As soon as the current through the primary winding $L_1$ of the ignition coil reaches its constant maximum value, the potential at the point C jumps above the potential existing at the point X. Thus the transistor $T_6$ of the comparator, acted upon by the low potential at the base, takes over the current from the current source $Q_1$, while the transistor $T_5$ and therefore the transistor $T_7$ are blocked. The collector potential at the transistors $T_7$ and $T_9$ and therefore at the output rises since there is high potential at the input E at the same time. A pulse-shaped voltage curve according to FIG. 3*d* is produced at the output, the pulse width $t_e$ of which corresponds exactly to the residence time of the maximum current $I_{pr}$ through the primary winding $L_1$. An analog or digital variable value can now be obtained from these pulses, this value being used to control or recontrol the beginning of the current flow through the primary winding after each ignition phase so that the current through the primary winding of the ignition coil reaches its maximum value always at the time of the ignition point. A subsequently connected RC element is charged up by the pulse according to FIG. 3*d* for example, so that there is a control voltage at this RC element, the amplitude of which corresponds to the residence time $t_e$ of the ignition coil current at its maximum. On the other hand, the pulse width $t_e$ can also be determined with the aid of a microprocessor in order to obtain a digital variable value in this way.

In the case of an embodiment with a stabilised direct voltage of $U_{stab}$=6.2 V, the resistor $R_4$ had the value of 500Ω and the resistor $R_2$ had a value of 2.6 kΩ. The circuit was implemented in integrated semiconductor technology.

It will be understood that the above description of the present invention is susceptible to various modification changes and adaptations.

I claim:

1. An electronic ignition system comprising: an ignition coil having a primary winding and a secondary winding; means defining a spark gap in series with said secondary winding; a primary transistor and a current limiting circuit in the circuit of said primary winding; a further transistor connected to be controlled by a control signal and connected in front of said primary transistor for controlling said primary transistor, said further transistor presenting a current path; a resistor network in the current path of said further transistor; and means connected to said further transistor and said resistor network for deriving pulses whose width represents the residence time of maximum current through said primary winding from the voltage curve at said resistor network and wherein said further transistor and said resistor network constitute means for causing said further transistor to operate in its saturation region when there is a rise in current in said primary winding and for producing a jump in voltage to a constant maximum value at said resistor network when the current in said primary winding is limited to its maximum value by said current limiting circuit.

2. An electronic ignition system as defined in claim 1 wherein: the control signal alternates cyclically between a first value for causing current to flow through said primary winding and a second value for causing a spark to be produced in said spark gap; said system further comprises a source of supply potential, a diode path, a bias resistor, and a switch connected to be controlled by the control signal such that said switch is open when the control signal has its first value and closed when the control signal has its second value; said resistor network comprises a resistor connected in the collector current path of said further transistor, and connected to the supply potential; the emitter of said further transistor is connected to the base of said primary transistor; and the base of said further transistor is connected to the supply potential via said bias resistor, to said switch, and to said current limiting circuit via said diode path so that when said switch is closed current flowing through said bias resistor is drawn off from the base of said further transistor via said switch, and when said switch is open the current flowing through said bias resistor flows solely into the base of said further transistor during the current rise phase in said primary winding, while during the residence time of maximum current flow in said primary winding a portion of the current flowing through said bias resistor is drawn off by said current limiting circuit to an extent which maintains the current in said primary winding constant.

3. An electronic ignition system as defined in claim 1, wherein said current limiting circuit comprises an operational amplifier, supplied at one input with a voltage corresponding to the current in said primary winding and connected at its output to the base of said further transistor.

4. An electronic ignition system as defined in claim 1, wherein said primary transistor and said further transistor are npn transistors.

5. An electronic ignition system as defined in claim 2 wherein said means for deriving pulses comprise: a comparator for comparing the collector potential of said further transistor with its base potential increased by the voltage drop across said diode path; and an AND-gate connected after said comparator and having a first input connected to receive a signal derived from the comparison performed by said comparator.

6. An electronic ignition system as defined in claim 5, wherein said AND-gate has a second input connected to receive the control signal, and an output for providing the pulses whose width represents the residence time of the maximum current in said primary winding, which pulses serve as a variable for time control of the beginning of the current flow through said primary winding after each ignition phase.

7. An electronic ignition system as defined in claim 2, and wherein said source of supply potential provides a stabilised supply potential to which said resistor network in the collector current path of said further transistor is connected.

* * * * *